US007641243B2

(12) United States Patent
Yuan

(10) Patent No.: US 7,641,243 B2
(45) Date of Patent: Jan. 5, 2010

(54) LATCH DESIGN WITH ADJUSTABLE BACKSET

(76) Inventor: Zhiman Yuan, Guangdong Janes Lock Co., Ltd., Dong An Road, Haizhou, Guzhen, Zhongshan City, Guangdong (CN)

( * ) Notice: Subject to any disclaimer, the term of this patent is extended or adjusted under 35 U.S.C. 154(b) by 202 days.

(21) Appl. No.: 11/699,932

(22) Filed: Jan. 30, 2007

(65) Prior Publication Data

US 2008/0179892 A1 Jul. 31, 2008

(51) Int. Cl.
*E05C 1/00* (2006.01)

(52) U.S. Cl. ..... 292/1.5; 292/DIG. 60

(58) Field of Classification Search ..... 292/1.5, 292/337, DIG. 60
See application file for complete search history.

(56) References Cited

U.S. PATENT DOCUMENTS

| | | | | |
|---|---|---|---|---|
| 4,746,154 | A * | 5/1988 | Fang | 292/337 |
| 6,293,597 | B1 * | 9/2001 | Huang | 292/1.5 |
| 6,334,635 | B1 * | 1/2002 | Huang | 292/1.5 |
| 6,536,816 | B1 * | 3/2003 | Fan | 292/337 |
| 6,688,660 | B2 * | 2/2004 | Huang | 292/337 |

* cited by examiner

*Primary Examiner*—Gary Estremsky
(74) *Attorney, Agent, or Firm*—Douglas S. Bishop

(57) ABSTRACT

An improved latch incorporating adjustable backset and cylinder latch bolt assemblies, working in cooperation with a door handle, mounting rods and spindle. The backset latch includes novel configured inner and outer casing parts through which extend the mounting rods and spindle, and which sandwich therebetween an actuating plate and follower plate arrangement. The cylinder latch bolt further includes a novel subassembly including a bolt mounted in spring biasing fashion via a stem portion extending therefrom and interengaging the actuating plate to selectively retract the bolt into a cylinder shaped and interiorly open body.

23 Claims, 4 Drawing Sheets

LATCH DESIGN WITH ADJUSTABLE BACKSET

BACKGROUND OF THE INVENTION

1. Field of the Invention

The present invention relates generally to tubular lock mechanisms and, more specifically, to such lock mechanisms as which incorporates an adjustable backset. More particularly, the present invention discloses an improved backset assembly incorporating modified inner and outer casing parts, as well as a novel "T" shaped hook portion associated with a sandwichingly disposed actuating plate, for the purpose of providing improved backset adjustment.

2. Description of the Prior Art

The prior art is well documented with examples of tubular lock assemblies with some form of adjustable backset structure. In particular, a desirable feature of such assemblies is the ability to conform to both longer and shorter backsets.

A first example of a tubular lock with backset adjustability is set forth in U.S. Pat. No. 6,293,597, issued to Huang, and which teaches a latch bolt cylinder engaged with a casing consisting of two casing parts. An actuating plate is mounted between the casing parts and includes two separate teeth and protrusions. A follower plate, including two separate teeth, is in close contact with the actuating plate and to which the protrusions bear against. A spindle of the tubular lock bears against two teeth of the follower plate, thereby allowing the actuating plate to retract the latch bolt indirectly. Alternatively, the actuating plate can be directly actuated to retract the latch bolt.

Another example of the prior art is set forth in U.S. Pat. No. 6,257,630, issued to Huang, and which teaches a tubular lock including a latch bolt cylinder that may be extended beyond the doorplate or retracted there into. A casing consists of two casing parts and is engaged to an inner end of the latch bolt cylinder. An actuating plate is mounted between the casing parts and includes two teeth and a number of protrusions. A follower plate is removably held by the protrusions and also has two teeth. A spindle of the tubular lock bears against the teeth of the follower plate or the actuating plate, thereby allowing the actuating plate to retract the latch bolt directly or indirectly. A movable plate is mounted between the casing parts and may be extended beyond the casing parts. The movable plate includes a positioning hole through which one of two mounting posts of the tubular lock extends.

Finally, another version of a latch bolt mechanism is disclosed in U.S. Pat. No. 6,334,635, again issued to Huang, and which differs from Huang '630 in that it teaches the teeth associated with the actuating plate as including a block formed thereon, the blocks being pressed against by a follower plate that also includes two teeth. When either tooth of the actuating plate or follower plate is pressed against by a spindle of the lockset, the latch bolt is retracted. An extension casing is mounted around the plates and movable toward or away from the latch bolt housing. The extension casing includes a first hole and a second hole through which the spindle of the lockset is selectively extended.

SUMMARY OF THE PRESENT INVENTION

The present invention discloses a latch design with adjustable backset and latch bolt features and which provides structural improvements over prior art latch designs. In particular, the present latch design provides an improved configuration associated with the inner and outer casing portions, as well as the intermediately disposed actuating portion, and such as to provide for improved backset adjustment and operation.

A handle is rotatably mounted to a housing, with a spindle extending from the handle in rotatably slaved fashion and a pair of fixed mounting rods extending from the housing in parallel fashion relative to the spindle. The backset subassembly is arranged in substantially perpendicular extending fashion relative to the spindle and mounting rods, the backset operatively engaging the handle and, in turn, actuating a latch bolt assembly to linearly withdraw in a direction towards the backset upon rotation of the handle.

Features of the backset include an inner casing part, an outer spaced apart and aligning casing part, and a linearly actuating plate and a follower plate sandwichingly engaged between the inner and outer casing parts. Each of the inner and outer casing parts having a specified shape and size and each includes a centrally located and aligning opening through which extends the spindle and in combination with at least first and second pairs of individual positioning holes arranged on opposite sides of the central aligning openings and for receiving the mounting rods therethrough. In a preferred arrangement, a third and outermost pair of aligning holes supplements the first side located pair of holes.

The actuating plate further includes a lengthwise extending and open interior for facilitating passage therethrough by the spindle and mounting rods. The actuating plate further includes an extending end exhibiting oppositely extending hook portions for engaging the latch bolt assembly. The follower plate seats between the casing parts and against the actuating plate to facilitate extension and retraction of the latch bolt assembly, the follower plate being linearly repositioned between shorter and longer backset positions relative to the casing parts.

The latch bolt assembly further includes a cylinder shaped and interiorly open body within which is mounted a bolt in spring biasing fashion, a stem portion extending from the bolt including gripping tabs for seating the hook portions of the actuating plate and for thereby translating said linear retraction of the actuator plate to the bolt.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
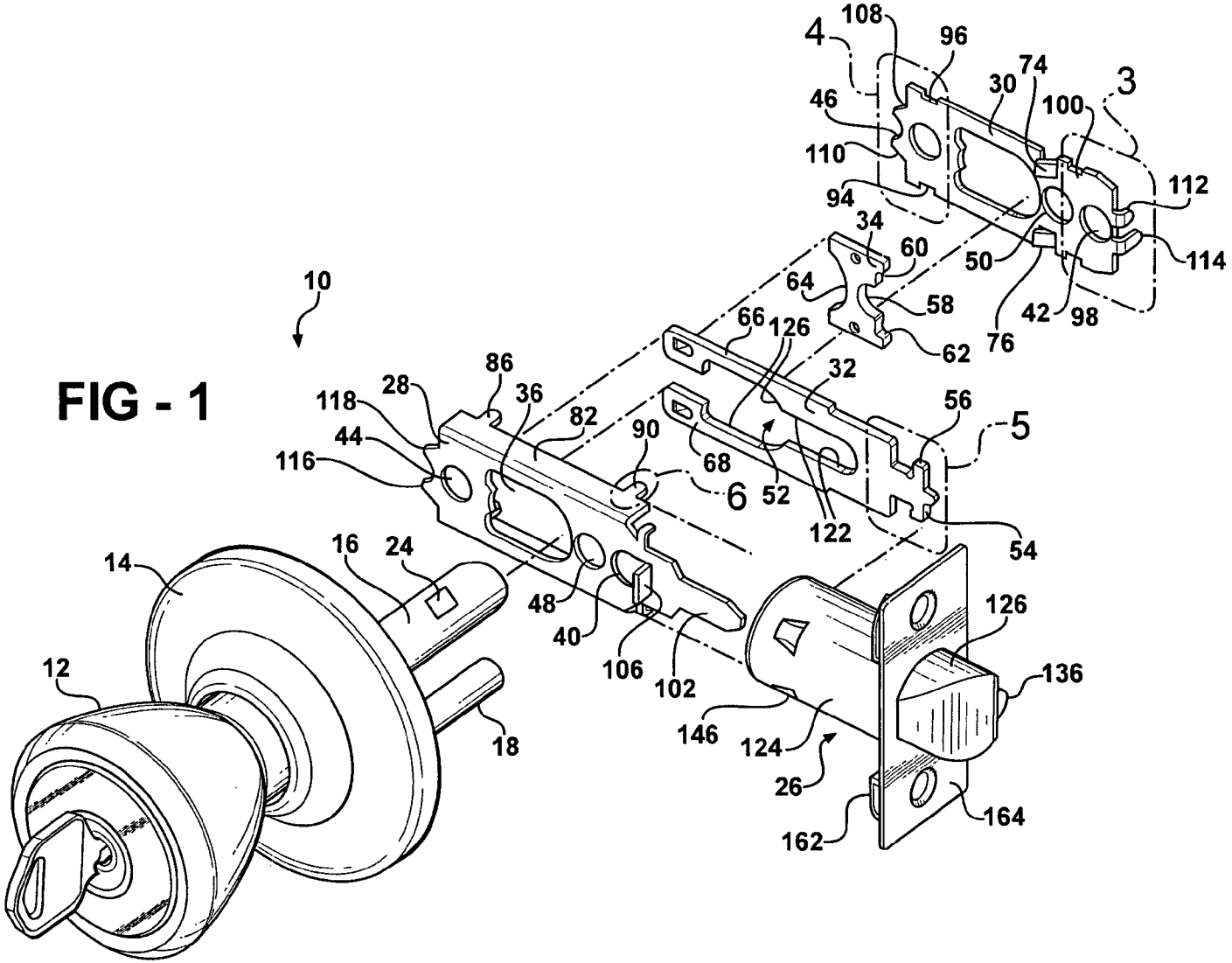
FIG. 1 is an exploded view of a latch assembly with adjustable backset according to the present inventions.

Referring to FIG. 1, an exploded view is illustrated generally at 10 of a latch assembly with adjustable backset according to the present inventions. As will be subsequently described, the present invention discloses a novel and adjustable backset latch and combination latch bolt assembly for incorporating into a handle activated and door locking assembly.

Although not shown, the latch assembly is incorporated into a door and door jamb application, and whereby suitable recess configurations are pre drilled or otherwise pre formed between the door and opposing door jamb. It is further understood that all of the components comprising the latch, backset and latch bolt are preferably constructed from a durable and high strength steel or other metal.

As shown in FIG. 1, a handle 12 is rotatably mounted to a housing, shown as being generally circular in shape at 14. As also shown in the rotated perspective view of FIG. 1A, a spindle 16 extends from the handle 12 in rotatably slaved fashion. A pair of fixed mounting rods 18 and 20 further extending from the housing 14 in parallel fashion relative to the spindle 16. As is best shown in FIG. 1A, the spindle 16 includes a pair of keyed openings 22 and 24, these as will be subsequently described engaging portions of the backset latch assembly and for the purpose of actuating the retraction of the lock cylinder bolt.

Figure 1A:
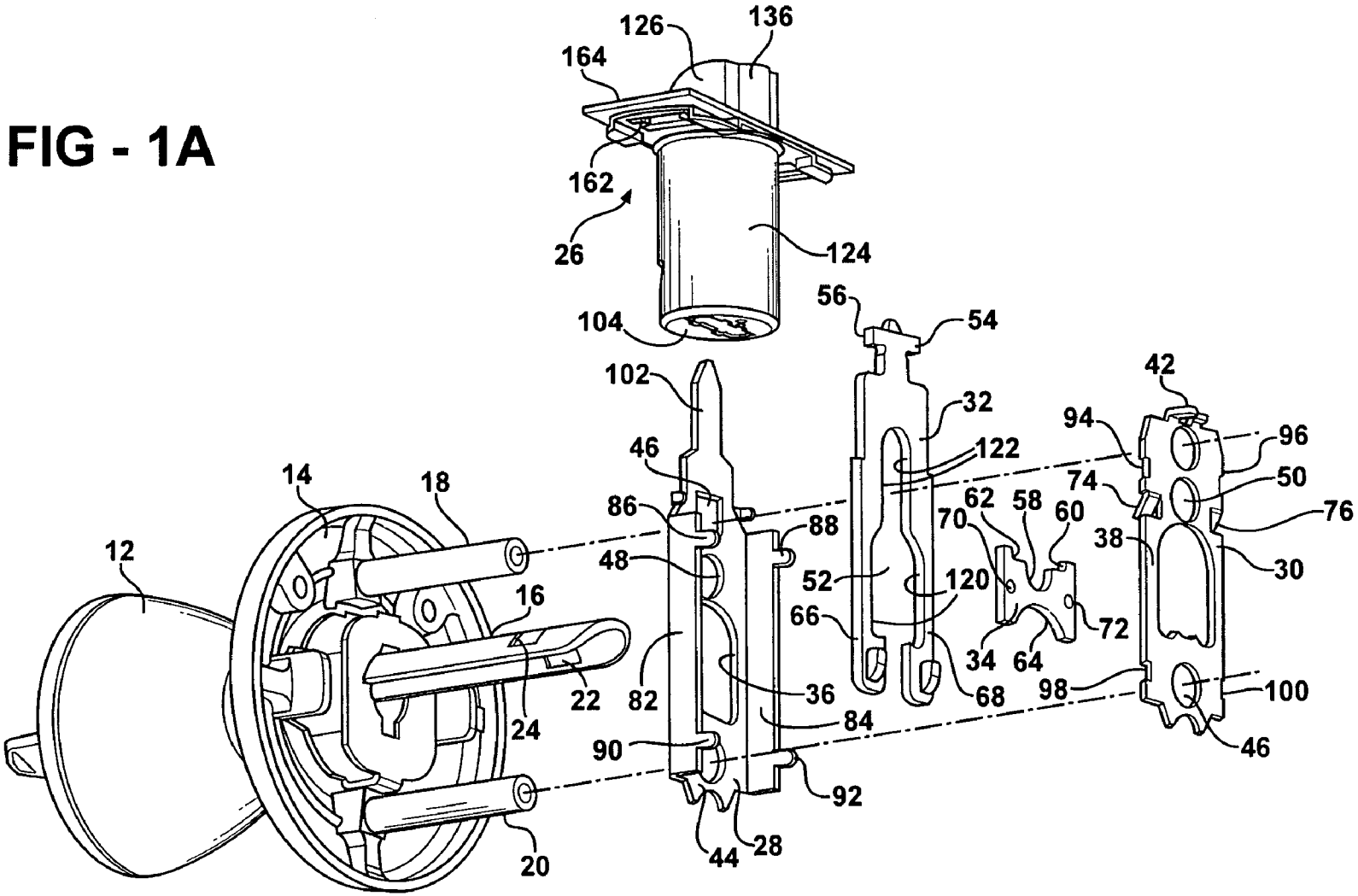
FIG. 1A is a rotated exploded perspective of the latch assembly shown in FIG. 1.

As clearly referenced in FIGS. 1 and 1A, a backset subassembly is illustrated in exploded manner and arranged in substantially perpendicular extending fashion relative to the spindle 16 and mounting rods 18 and 20. As will be described subsequently in further detail, the backset is operatively engaged by the handle 12 and, in turn, actuates a latch bolt assembly (see as generally shown at 26 in FIG. 1) to linearly withdraw in a direction towards the backset, upon rotation of said handle.

In relevant part, the backset assembly includes an inner casing part 28 and an outer spaced apart and aligning casing part 30. As will be described in additional detail, a linearly actuating plate 32 and a follower plate 34 are sandwichingly engaged between the inner 28 and outer 30 casing parts.

Each of the inner 28 and outer 30 casing parts have a specified shape and size and include a centrally located and aligning opening (see arcuate shaped openings defined by inner boundary edges 36 and 38) and through which extends the spindle 16. In combination, first and second pairs of individual positioning and aligning holes (see at 40 & 42 and at 44 & 46) are arranged on opposite sides of the central aligning openings for parts 28 and 30, and for receiving the mounting rods 18 and 20 therethrough. A third pair of apertures 48 & 50 are further illustrated in association with the casing parts 28 and 30 and are positioned in likewise aligning fashion between the first pair of apertures 40 & 42 and the arcuate central openings 36 and 38.

The actuating plate 32 further includes a lengthwise extending and open interior 52 for facilitating passage therethrough by the spindle 16 and mounting rods 18 and 20. The actuating plate 32 further exhibits an extending end with oppositely arrayed hook portions 54 and 56 (see also enlarged view of FIG. 5), and for engaging the latch bolt assembly 26.

The follower plate 34 seats between the casing parts 28 and 30 and in sliding fashion against the actuating plate 32 to facilitate extension and retraction of the latch bolt assembly 26. The follower plate 34 is further linearly repositioned between shorter and longer backset positions relative to the casing parts. To facilitate such action, the follower plate 34 includes a first edge extending and arcuate recess 58 terminating, at opposite ends, in a pair of teeth 60 and 62 (these being dimensioned such as to receive the key apertures defined in circumferential offset along the spindle 16 as previously described at 22 and 24). A second opposite edge including a likewise central extending and arcuate recess 64.

In a shorter backset position, a selected on of the teeth 60 or 62 engages the rotating spindle, simultaneously with contacting protrusions associated with end legs, see at 66 and 68 of the actuating plate 32 extending opposite the hook portions 54 and 56 thereof, and to indirectly retract the bolt assembly 26. In the longer backset position, the follower plate 34 is moved longitudinally relative to the inner 28 and outer 30 casing parts, such that the first arcuate recess 58 is positioned in alignment with a selected pair of aligning and individual positioning holes (e.g. at 40 and 42) through which a selected mounting rod 18 extends, and further such that the second arcuate recess 64 of the follower plate 34 operates as an axle bearing against the spindle 16 in order to rotate at a fixed point.

Additional features associated with the backset includes the follower plate 34 exhibiting a pair of bead shaped protrusions, see at 70 and 72 in the rotated view of FIG. 1A, these extending from an exposed face thereof. A pair of angled edge tabs 74 and 76 are associated with the outer casing part 30 and contact the bead shaped protrusions 70 and 72 to define a linear end stop position of the follower plate 34 within the backset subassembly.

Figure 5:
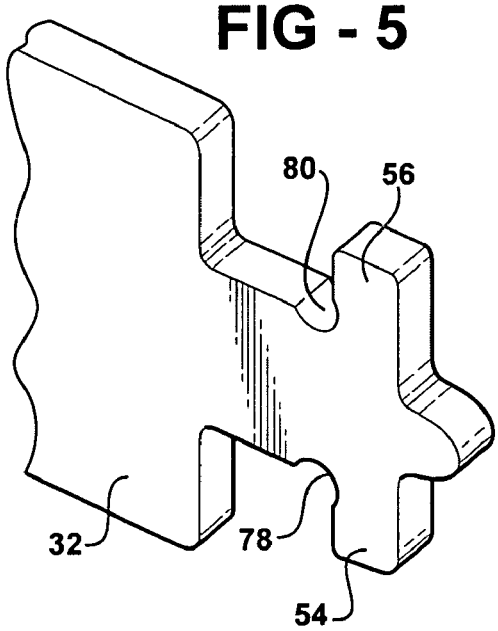
FIG. 5 is an enlarged partial end view of a substantially "T" shaped hook portion associated with the intermediate positioned actuating plate.

The actuating plate 32 further exhibits a specified and generally flattened configuration with the opposite extending hook portions 54 and 56 each further including a substantially rectangular shape. A pair of inner arcuate edges, see at 78 and 80 as best shown in FIG. 5, are associated with each hook portion 54 and 56, thereby defining a seating location for receiving appropriate gripping components of the lock bolt assembly 26 (and as will be shortly described as including a gripping tabs associated with a stem portion of the retractable latch bolt).

Figure 4:
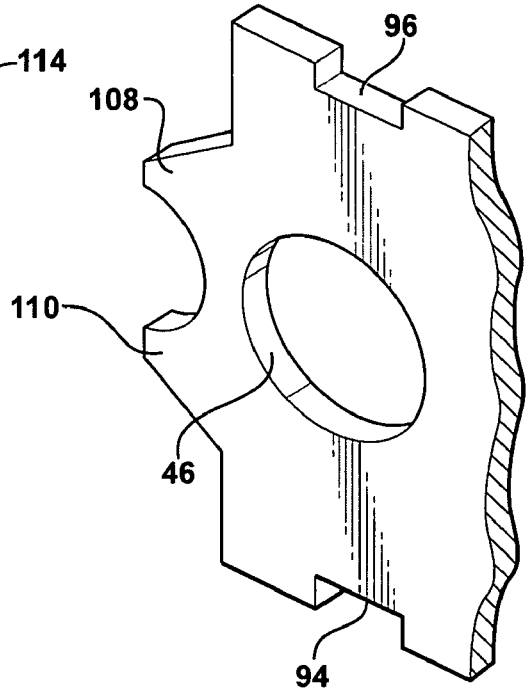
FIG. 4 is a further partial view of an end portion of the outer casing part and illustrating a unique end serration configuration.
Figure 6:
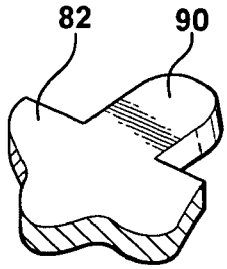
FIG. 6 is a fragmentary view of a tab shaped and extending side edge associated with the inner casing part.

Additional features of the inner casing part 28 includes a pair of angularly extending side walls 82 and 84, first and second pairs of finger portions 86 & 88 and 90 & 92 extending from first and second (typically end) locations of each of the side walls 82 and 84. Reference is also made to the enlarged view of FIG. 6 illustrating the shaping of selected finger gripping portion 90. The outer casing part 30 further includes a substantially plate-shaped (i.e. flattened) configuration with side edge notches (see at 94 & 96 and 98 & 100), see also FIG. 4, these aligning and assembling with the finger portions 86, 88, 90 and 92 associated with the inner casing part 28 for seatingly engaging to the inner casing part in a desired spaced apart fashion.

The inner casing portion 28 further includes an integral and forward extending blade portion 102, this inserting through a slot shaped aperture 104 (see FIG. 1A) associated with an end face of the latch bolt 26 and providing coplanar support with the actuating plate 32. A tab 106 (see FIG. 1) extends from a forward location of the inner casing part 28 and engages an inside edge surface of the bolt slot aperture 104.

Figure 3:
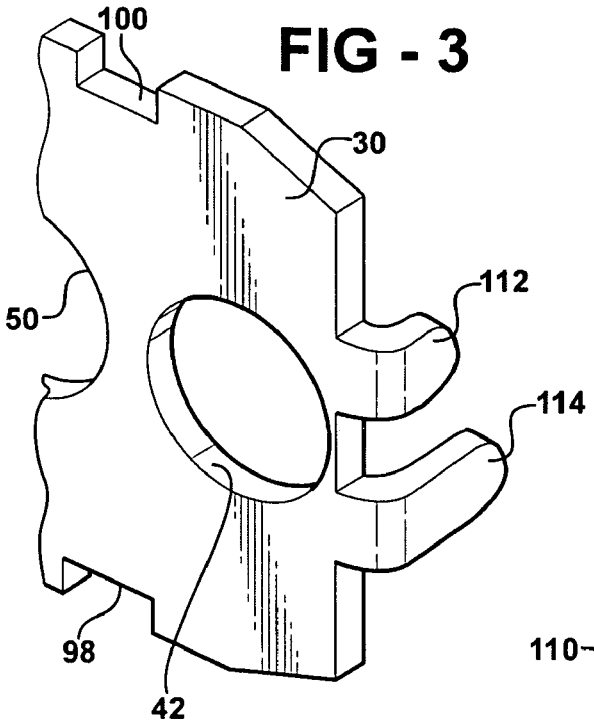
FIG. 3 is an enlarged partial view of an end portion of the outer casing part and illustrating the provision of a distinct and additional positioning hole.

The outer casing part 30 further includes a first pair of linearly edge extending gripping portions, at 108 & 110 (again also FIG. 4), and a second pair of angled and opposite edge extending gripping portions 112 & 114 (see also FIG. 3) for securing the assembled backset in a desired mounting position within a door (not shown). A further pair of linearly edge extending gripping portions are also shown at 116 & 118 for inner casing part 28 and in order to further assist in securing in place the backset assembly.

Additional features of the actuating plate 32 include its open interior (see as previously shown at 52) defining a larger interior aperture (see opposing inner walls 120) located approximate the end legs 66 and 68. An interconnecting and narrowed aperture (see further opposing inner walls 122) extends forwardly in a direction towards the hook portions 54 and 56.

Figure 2:
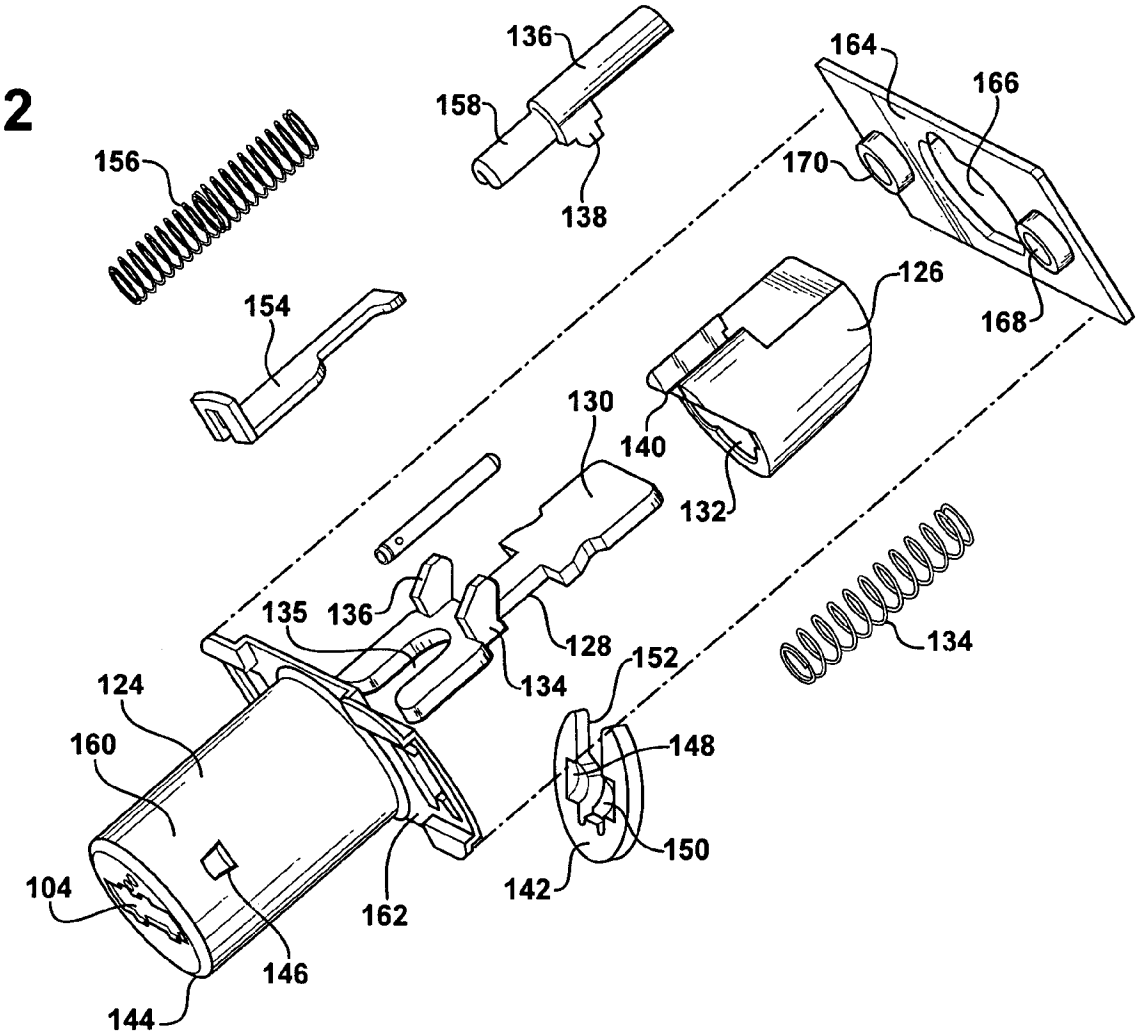
FIG. 2 is a sectional exploded view of the latch bolt cylinder housing incorporated into the latch assembly.

Referring now to FIG. 2, when viewed in combination with the perspective illustrations of FIGS. 1 and 1A, an exploded illustration is shown of the latch bolt assembly 26 and which includes a cylinder shaped and interiorly open body 124, within which is mounted a bolt 126 in spring biasing fashion. The bolt 126, as known, exhibits a rounded arcuate outer profile along one edge which converges with a substantially straight edge to define a seating and opening preventative surface within a suitable door jamb mounted receptacle (not shown).

A stem portion 128 (FIG. 2) extends from the bolt 126 and includes a flattened forward end 130 which seats within an apertured interior 132 associated with the bolt 126 or can be otherwise integrally formed or mounted therewith. The stem 128 also includes gripping tabs 134 and 136, these provided for seating and engaging the hook portions 54 and 56 of the actuating plate 32, and for thereby translating the linear retraction of the actuator plate 32 (as influenced by the action of the spindle 16 upon the follower plate 34) to the bolt 126. The end of the stem 128 opposite the bolt inserting end 130 is illustrated with a substantially "U" shaped configuration, see at 132, it being understood that the shaping of the stem is dictated by dimensional considerations associated with the lock cylinder body interior 124 and the inserting components of the actuating plate 32 hook portions 54 and 56 and the blade portion 102 of the inner casing part 28.

Referring again to FIG. 2, a primary spring 134 is positioned so as to be supported upon a surface of the stem portion body 128 and which biases at opposite ends with the bolt 126 and the cylinder body 124 interior, so as to influence the bolt 126 in an outward direction relative to the cylinder shaped body 126. An anti-theft pin 136 is supported in both individually retractable and slaved fashion relative to the bolt 126, this feature accomplished by the keyed arrangement established between an underside projection 138 of the pin 136 and an end-stop 140 defined upon an upper surface of the bolt 126 and communicating with guide surfaces for seating thereupon the pin 136. Upon mounting the pin 136 to the bolt 126, the pin is permitted to selectively and individually displace in a direction towards the bolt cylinder 124 (relative to the main bolt 126) while being slaved for concurrent inward displacement along with the bolt 126 and as a result of its end stop 140 catching the pin underside projection 138. thereby preventing the, a secondary spring supported upon opposing shaft portions associated with said anti-theft pin and a further pin mounted to an inside end surface of said open body.

The latch bolt assembly further includes a disk portion, see at 142, this being insertable within the open end of the cylinder shaped body 124. A pair of circumferentially spaced apart end stops are shown at 144 and 146 (see in phantom in FIG. 2 as well as in FIG. 1) associated with intermediate inner locations of the open body 124, these abutting lower edge locations of the insertable disk portion 142. A cross wise slot is defined within and extends along the disk portion 142, from an opposite top edge thereof, and defines first locations (see at 148 and 150) for engaging the extending stem gripping portions 134 and 136, as well as a second location (at 152) for permitting passage therethrough of said anti-theft pin 136.

A secondary shoulder plate, at 154, is supported upon a surface of the bolt retracting stem portion 128, and for guidably supporting a secondary spring 156 which is secured at opposite ends to aligning and seating locations associated with both the anti-theft pin 136, at 158, as well as with a pin 160 mounted in extending fashion to an end wall surface of the bolt cylinder 124, and through which the slot shaped aperture 104 is defined. A support plate 162 is secured in integrally extending fashion relative to the open end of the bolt assembly body 124. A face plate 164 is sandwichingly engaged against the underlying support plate 162 and further defines an interior aperture 166 (FIG. 2) for permitting passage therethrough of said bolt and anti-theft pin, as well as additional fastener mounting apertures 168 and 170 positioned astride the pin passage aperture 166.

Having described my invention, other and additional preferred embodiments will become apparent to those skilled in the art to which it pertains, and without deviating from the scope of the appended claims.

The invention claimed is:

1. A latch assembly, comprising:

a handle rotatably mounted to a housing, a spindle extending from said handle in rotatably slaved fashion, a pair of fixed mounting rods extending from said housing in parallel fashion relative to said spindle;

a backset subassembly arranged in substantially perpendicular extending fashion relative to said spindle and mounting rods, said backset operatively engaging said handle and, in turn, actuating a latch bolt assembly to linearly withdraw in a direction towards said backset, upon rotation of said handle, said backset comprising:

an inner casing part;

an outer spaced apart and aligning casing part;

a linearly actuating plate and a follower plate sandwichingly engaged between said inner and outer casing parts;

each of said inner and outer casing parts having a specified shape and size and including a centrally located and aligning opening through which extends said spindle, in combination with at least first and second pairs of individual positioning holes arranged on opposite sides of said central aligning openings and for receiving said mounting rods therethrough;

said actuating plate further comprising a lengthwise extending and open interior for facilitating passage therethrough by said spindle and mounting rods, said actuating plate further comprising an extending end exhibiting oppositely extending hook portions for engaging said latch bolt assembly;

said follower plate seating between said casing parts and against said actuating plate to facilitate extension and retraction of said latch bolt assembly, said follower plate being linearly repositioned between shorter and longer backset positions relative to said casing parts; said follower plate having a specified shape and size and further comprising, said follower plate having a specified shape and size and further comprising:

a first edge extending and arcuate recess terminating, at opposite ends, in a pair of teeth; and a second opposite edge including a likewise central extending and arcuate recess;

whereupon, in said shorter backset position, a selected on of said teeth engages said rotating spindle simultaneously with contacting protrusions associated with end legs of said actuating plate opposite said hook portions and to indirectly retract said bolt;

whereupon, in said longer backset position, said follower plate is moved longitudinally relative to said inner and outer casing parts such that said first arcuate recess is positioned in alignment with a selected pair of aligning and individual positioning holes through which a selected mounting rod extends, and further such that said second arcuate recess operates as an axle bearing against said spindle in order to rotate at a fixed point; said follower plate further comprising a pair of bead shaped protrusions extending from an exposed face thereof, a pair of angled edge tabs associated with said outer casing part contacting said beads to define a linear end stop position of said follower plate; and said latch bolt assembly further comprising a cylinder shaped and interiorly open body within which is mounted a bolt in spring biasing fashion, a stem portion extending from said bolt including gripping tabs for seating said hook portions of said actuating plate and for thereby translating said linear retraction of said actuator plate to said bolt.

2. The latch assembly as described in claim 1, said actuating plate exhibiting a specified shape and size, said opposite extending hook portions each further comprising a substantially rectangular shape, an inner arcuate edge associated with each defining a seating location for said stem portion gripping tabs of said retractable latch bolt.

3. The latch assembly as described in claim 1, said inner casing part further comprising a pair of angularly extending side walls, finger portions extending from first and second end locations of each of said side walls.

4. The latch assembly as described in claim 3, said outer casing part further comprising a substantially plate-shaped configuration and including side edge notches aligning with said finger portions for seatingly engaging to said inner casing part in a desired spaced apart fashion.

5. The latch assembly as described in claim 3, said inner casing portion further comprising an integral and forward extending blade portion inserting through a slot shaped aperture associated with an end face of said latch bolt body and providing coplanar support to said actuating plate, a tab extending from a forward location of said inner casing part and engaging an inside edge surface of said slot aperture.

6. The latch assembly as described in claim 4, said outer casing pare further comprising at least one of a first pair of linearly edge extending gripping portions and a second pair of angled and opposite edge extending gripping portions for securing said assembled backset in a desired mounting position within a door.

7. The larch assembly as described in claim 1, said actuating plate having a specified shape and size, said open interior further comprising a larger interior aperture located approximate said end legs, an interconnecting and narrowed aperture extending forwardly in a direction towards said hook portions.

8. The latch assembly as described in claim 1, said latch bolt assembly further comprising a primary spring supported upon said stem portion and for biasing said bolt in an outward direction relative to said cylinder shaped body.

9. The latch assembly as described in claim 8, further comprising an anti-theft pin supporting in both individually retractable and slaved fashion relative to said bolt, a secondary spring supported upon opposing shaft portions associated with said anti-theft pin, and a further pin mounted to an inside end surface of said open body.

10. The latch assembly as described in claim 9, said latch bolt assembly further comprising a disk portion insertable within said open end of said cylinder shaped body, a pair of circumferentially spaced apart end stops associated with intermediate inner locations of said open body abutting lower edge locations of said insertable disk portion, a cross wise slot extending in said disk portion from an opposite top edge thereof and defining a first location for engaging said extending stem gripping portions and a second location for permitting passage therethrough of said anti-theft pin.

11. The latch assembly as described in claim 10, further comprising a secondary shoulder plate supported upon a surface of said bolt retracting stem portion, and for guidably supporting said secondary spring.

12. The latch assembly as described in claim 9, said latch bolt further comprising a support plate secured in integrally extending fashion relative to said open end of said bolt assembly body, a face plate sandwichingly engaging against said support plate and defining an interior aperture for permitting passage therethrough of said bolt and and-theft pin.

13. The invention as described in claim 1, said selected pair of aligning and individual positioning holes associated with said casing parts further comprising an outermost pair of aligning holes for receiving therethrough said associated mounting rod, an innermost pair of aligning holes being disposed between said outer pair and said aligning central openings.

14. A combined backset latch assembly and latch bolt assembly incorporated into a door handle, the handle being rotarably mounted relative to a housing secured against a surface of a door and including a spindle extending from the handle in rotatably slaved fashion, a pair of fixed mounting rods extending from the housing in parallel fashion relative to the spindle, said assemblies comprising;

said backset latch comprising inner and outer casing parts each having a specified shape and size and including a centrally located and aligning opening through which extends the spindle, first and second pairs of positioning holes being defined in each of said casing parts, separate from and on opposite sides of said central aligning apertures, and receiving therethrough at least one of the mounting rods, said inner and outer casing parts sandwiching therebetween a linearly actuating plate and a follower plate, said actuating plate further including a lengthwise extending open interior terminating at a first end in a pair of laterally projecting and forward end disposed hook portions and, at a second end, in a pair of end legs exhibiting contacting protrusions for engagement by said follower plate; said follower plate further comprising a pair of bead shaped protrusions extending from an exposed face thereof, a pair of angled edge tabs associated with said outer casing part contacting said beads to define a linear end stop position of said follower plate; and said latch bolt assembly further comprising a cylinder shaped and interiorly open body having a slot shaped opening through which said actuating plate extends and within which is mounted a bolt in spring biasing fashion, a stem portion extending from said bolt including gripping tabs for seating said hook portions of said actuating plate and for thereby translating said linear retraction of said actuator plate to said bolt;

upon selected linear displacement of said follower plate, corresponding to either of first and second backset positions, rotation of said handle resulting in said backset operatively engaging said handle and, in turn, actuating said latch bolt to linearly withdraw in a direction towards said backset.

15. The invention as described in claim 14, said actuating plate exhibiting a specified shape and size, said opposite extending hook portions each further comprising a substantially rectangular shape, an inner arcuate edge associated with each defining a seating location for said stem portion gripping tabs of said retractable latch bolt.

16. The invention as described in claim 14, said inner casing part further comprising a pair of angularly extending side walls, finger portions extending from first and second end locations of each of said side walls.

17. The invention as described in claim 16, said outer casing part further comprising a substantially plate-shaped configuration and including side edge notches aligning with said finger portions for seatingly engaging to said inner casing part in a desired spaced apart fashion.

18. The invention as described in claim 16, said inner casing portion further comprising an integral and forward extending blade portion inserting through a slot shaped aperture associated with an end face of said latch bolt body and providing coplanar support with to said actuating plate, a tab extending from a forward location of said inner casing part and engaging an inside edge surface of said slot aperture.

19. The invention as described in claim 17, said outer casing part further comprising at least one of a first pair of linearly edge extending gripping portions and a second pair of angled and opposite edge extending gripping portions for securing said assembled backset in a desired mounting position within a door.

20. The latch bolt assembly as described in claim 19, said latch bolt assembly further comprising a primary spring supported upon said stem portion and for biasing said bolt in an outward direction relative to said cylinder shaped body.

21. The latch bolt assembly as described in 19, said latch bolt assembly further comprising a primary spring supported upon said stem portion and for biasing said bolt in an outward direction relative to said cylinder shaped body.

22. The latch bolt assembly as described in claim 20, further comprising an anti-theft pin supporting in both individually retractable and slaved fashion relative to said bolt, a secondary spring supported upon opposing shaft portions associated with said anti-theft pin and a further pin mounted to an inside end surface of said open body.

23. The invention as described in claim 14, said selected pair of aligning and individual positioning holes associated with said casing parts of said backset latch further comprising a third outermost disposed pair of aligning holes defined in each of said inner and outer casing parts in spaced apart manner relative to said first pair of positioning holes for receiving therethrough an associated mounting rod, an innermost pair of aligning holes being disposed between said outer pair and said aligning central openings.

* * * * *